US007582028B2

(12) United States Patent
Aoyama

(10) Patent No.: US 7,582,028 B2
(45) **Date of Patent: *Sep. 1, 2009**

(54) GOLF BALL WITH LOBED DIMPLES

(75) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/059,283

(22) Filed: Mar. 31, 2008

(65) Prior Publication Data

US 2008/0214327 A1 Sep. 4, 2008

Related U.S. Application Data

(63) Continuation of application No. 11/279,478, filed on Apr. 12, 2006, now Pat. No. 7,367,904, which is a continuation of application No. 10/800,448, filed on Mar. 15, 2004, now Pat. No. 7,056,233, which is a continuation of application No. 10/153,930, filed on May 23, 2002, now Pat. No. 6,749,525.

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | |
|---|---|---|---|
| 1,681,167 | A | 8/1928 | George |
| 4,090,716 | A | 5/1978 | Martin |
| 4,560,168 | A | 12/1985 | Aoyama |
| 4,830,378 | A | 5/1989 | Aoyama |
| 4,869,512 | A | 9/1989 | Nomura et al. |
| 4,960,282 | A | 10/1990 | Shaw |
| 5,016,887 | A | 5/1991 | Jonkouski |
| 5,174,578 | A | 12/1992 | Oka et al. |
| 5,338,039 | A | 8/1994 | Oka et al. |
| 5,377,989 | A | 1/1995 | Machin |
| 5,470,076 | A | 11/1995 | Cadorniga |
| 5,566,943 | A | 10/1996 | Boehm |
| 5,735,757 | A | 4/1998 | Moriyama |
| 5,842,937 | A | 12/1998 | Dalton et al. |
| 5,957,786 | A | 9/1999 | Aoyama |
| 6,162,136 | A | 12/2000 | Aoyama |
| 6,290,615 | B1 | 9/2001 | Ogg |
| 6,315,686 | B1 | 11/2001 | Barfield |
| 6,331,150 | B1 | 12/2001 | Ogg |
| 6,358,161 | B1 | 3/2002 | Aoyama |

(Continued)

FOREIGN PATENT DOCUMENTS

| | | | |
|---|---|---|---|
| EP | 536725 | A1 | 4/1993 |

(Continued)

*Primary Examiner*—Raeann Trimiew
(74) *Attorney, Agent, or Firm*—Kristin D. Wheeler

(57) ABSTRACT

A golf ball with multi-lobed dimples is provided. The dimple comprises a plurality of lobes positioned radially around the center of the dimple, wherein each lobe is defined by a circumferential segment. Each lobe comprises a first curved profile extending from the circumferential segment toward the center of the dimple and the first curved profile of each lobe abuts each other in an uninterrupted manner. The curvature of the circumferential segments can be defined by a ratio of an inside radius to an outside radius.

20 Claims, 6 Drawing Sheets

U.S. PATENT DOCUMENTS

| | | | | |
|---|---|---|---|---|
| 6,409,615 | B1 | 6/2002 | McGuire et al. | |
| 6,471,605 | B2 | 10/2002 | Ogg | |
| 6,475,106 | B1 | 11/2002 | Green | |
| 6,547,678 | B2 | 4/2003 | Barfield | |
| 6,569,038 | B2 | 5/2003 | Sullivan | |
| 6,599,204 | B2 | 7/2003 | Kasashima et al. | |
| 6,709,349 | B2 | 3/2004 | Sullivan | |
| 6,749,525 | B2 * | 6/2004 | Aoyama | 473/383 |
| 6,843,736 | B2 | 1/2005 | Kasashima | |
| 6,905,426 | B2 | 6/2005 | Morgan | |
| 6,958,020 | B1 | 10/2005 | Ogg et al. | |
| 7,056,233 | B2 * | 6/2006 | Aoyama | 473/383 |
| 7,367,904 | B2 * | 5/2008 | Aoyama | 473/383 |
| 2002/0025864 | A1 | 2/2002 | Barfield | |

FOREIGN PATENT DOCUMENTS

| | | | |
|---|---|---|---|
| GB | 2103939 | A | 3/1983 |
| JP | 2002336377 | A | 11/2002 |

* cited by examiner

10

$R_i/R_o = 0.70$ $R_i/R_o = 0.80$ $R_i/R_o = 0.90$ $R_i/R_o = 0.95$

GOLF BALL WITH LOBED DIMPLES

CROSS REFERENCE TO RELATED APPLICATION

This application is a continuation of U.S. application Ser. No. 11/279,478, filed on Apr. 12, 2006, now U.S. Pat. No. 7,367,904 which is a continuation of U.S. application Ser. No. 10/800,448, filed Mar. 15, 2004, now U.S. Pat. No. 7,056,223, which is a continuation of U.S. application Ser. No. 10/153,930, now U.S. Pat. No. 6,749,525, entitled GOLF BALL DIMPLES, and filed on May 23, 2002, the disclosures of which are incorporated herein by reference in their entireties.

FIELD OF THE INVENTION

The present invention relates to golf balls, and more particularly, to a golf ball having improved dimples.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, a reduction in the area of the wake, an increase in the pressure behind the ball, and a substantial reduction in drag are realized. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.100 inches to about 0.180 inches.

When compared to one conventional size dimple, theoretically, an increased number of small dimples may enhance aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball partially fills the small dimples, and consequently decreases the dimple's aerodynamic effectiveness. On the other hand, a smaller number of large dimples also begin to lose effectiveness. This results from the circumference of one large dimple being less than that of a group of smaller dimples.

One attempt to improve the aerodynamics of a golf ball is to create a ridge-like polygon inside a non-circular dimple and near the center of the dimple, where the edges of the polygon are positioned below the un-dimpled surface of the ball. This approach is described in U.S. Pat. No. 6,315,686 B1 and U.S. Patent Application Publication No. 2002/0025864 A1. The '686B1 and '864A1 references theorize that the polygonal ridges generate the turbulent boundary layer during low and intermediate ball velocities, and the non-circular dimples with the polygonal centers are used in conjunction with the conventional circular dimples on a golf ball. U.S. Pat. No. 4,869,512 also discloses the use of non-circular dimples with conventional circular dimples to improve aerodynamic performance of a golf ball. These non-circular dimples have shapes that include triangular, petal, oblong, and partially overlapping circles, among others. Additionally, U.S. Pat. No. 5,377,989 discloses non-circular isodiametrical dimples, wherein the dimples have an odd number of curved sides.

Another approach for improving the aerodynamics of a golf ball is suggested in U.S. Pat. No. 6,162,136, wherein a preferred solution is to minimize the land surface or undimpled surface of the ball to maximize dimple coverage. One way of maximizing the dimple coverage of the ball is to pack closely together circular dimples having various sizes, as disclosed in U.S. Pat. Nos. 5,957,786 and 6,358,161. In practice, the circular dimple coverage is limited to about 85% or less when non-overlapping dimples are used. Another attempt to maximize dimple coverage is to use polygonal dimples with polyhedron dimple surfaces, i.e., dimple surfaces constructed from planar surfaces, as suggested in a number of patent references including U.S. Pat. Nos. 6,290,615B1, 5,338,039, 5,174,578, 4,090,716, and 4,830,378, among others. Theoretically, higher dimple coverage is attainable with these polygonal dimples. However, it has been demonstrated that polygonal dimples with polyhedron dimple surfaces do not achieve performance improvements commensurate with their coverage improvements. It is believed that the linear edges of the polygonal dimples and the connecting sharp apices generate more drag than the curved edges of the circular dimples.

Hence, there remains a need in the art for a golf ball that has a high dimple coverage and superior aerodynamic performance.

SUMMARY OF THE INVENTION

The present invention is directed to a golf ball with improved dimples.

The present invention is also directed to a golf ball with improved aerodynamic characteristics.

The present invention is also directed to an arrangement of the improved dimples on a golf ball.

The present invention is directed to a dimple comprising a plurality of lobes positioned radially around the center of the dimple, wherein each lobe is defined by a circumferential segment and the circumferential segments define at least a part of the perimeter of the dimple. Each lobe comprises a first curved profile extending from the circumferential segment to the center of the dimple and the first curved profile of each lobe abuts each other in an uninterrupted manner. The lobes may be further defined by spoke-like ridges positioned between adjacent lobes. These spoke-like ridges may extend from the perimeter toward the center of the dimple or to the center of the dimple. Each lobe further comprises a second curved profile extending across the width of the lobe. Alternatively, the portions of the perimeter where the circumferential segments abut can be rounded. Additionally, the size, shape and/or angular spacing of the lobes on a single dimple may vary.

The curvature or prominence of the lobes can be defined by a ratio of an inside radius (Ri) to an outside radius (Ro). The inside radius extends from the center to a trough or a location on the lobe radially closest to the center. The outside radius extends from the center to an apex point of the lobe. In accordance to one aspect of the present invention, the inventive dimple includes uniform multi-lobed dimples. The inside radius and outside radius are constant for all these lobes, and the prominence of each lobe is the same as that for the other lobes in the same dimple. The prominence ratio for uniform lobes is less than 1.0. Preferably, this ratio is between about 0.70 and about 0.95; more preferably the ratio is between about 0.75 and about 0.90; and most preferably the ratio is between about 0.80 and about 0.90.

In accordance to another aspect of the present invention, the inventive dimple also includes non-uniform multi-lobed dimples. These non-uniform multi-lobed dimples can be either concentric or eccentric. Concentric non-uniform multi-lobed dimples include dimples with the center of Ri coincides with the center of Ro, and eccentric non-uniform multi-lobed dimples include dimples with the center of Ri being spaced apart from the center of Ro.

Concentric non-uniform multi-lobed dimples may have a constant Ri and a constant Ro. Additionally, concentric non-uniform multi-lobed dimples may include those with a constant Ri and varying Ro, those with varying Ri and constant Ro, and those with varying Ri and varying Ro. Although, the prominence of each lobe may be different than other lobes in the same dimple, the prominence ratio for the concentric non-uniform multi-lobed dimple is the ratio of Ri (or average Ri) to Ro (or average Ro). The prominence ratio is preferably less than 1.0. Preferably, this ratio is between about 0.70 and about 0.95; more preferably the ratio is between about 0.75 and about 0.90; and most preferably the ratio is between about 0.80 and about 0.90.

Eccentric non-uniform multi-lobed dimples may also have constant Ri and Ro. They may also have either varying Ri or varying Ro, or both. The prominence ratio for eccentric non-uniform multi-lobed dimples is defined similarly to the prominence ratio for concentric non-uniform multi-lobed dimples.

The dimple may comprise any number of lobes. For illustrative purposes, the dimple of the present invention is depicted to have between three and seven lobes.

The present invention is also directed to a golf ball having the multi-lobed dimples incorporated on its outer surface. In accordance to one aspect of the present invention, the multi-lobed dimples are arranged in a hexagonal array, wherein one multi-lobed dimple is surrounded by six multi-lobed dimples. The multi-lobed dimples are preferably arranged in an icosahedron pattern. The icosahedron pattern further comprises twelve vertex dimples, wherein each vertex dimple is surrounded by five multi-lobed dimples.

In accordance to another aspect of the present invention, the golf ball comprises uniform multi-lobed dimples and non-uniform multi-lobed dimples arranged in an icosahedron pattern. Preferably, the uniform lobed dimples occupy a substantial portion of the outer surface on the golf ball and the non-uniform multi-lobed dimples surround the vertex dimples to improve dimple coverage.

In accordance to another aspect of the present invention, the number of lobes of each multi-lobed dimple is the same as the number of dimples surrounding said multi-lobed dimple. Hence, each multi-lobed dimple in the hexagonal array comprises six lobes, and each vertex dimple comprises five lobes.

In accordance to another aspect of the present invention, the apex points of adjacent lobes straddle a line connecting the centers of adjacent dimples to maximize dimple coverage.

The multi-lobed dimples of the present invention improve the aerodynamic performance of a golf ball, because they provide greater dimple circumference on the golf ball than non-overlapping conventional circular dimples. They also provide higher dimple coverage, i.e., as much as about 93%, than dimensionally similar non-overlapping conventional circular dimples.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1A:
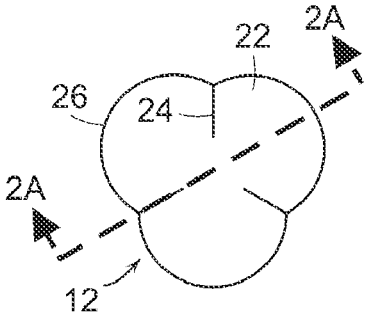
FIGS. 1(A)-1(E) are plan views of preferred embodiments of the uniform multi-lobed dimple of the present invention.

As illustrated in FIGS. 1(A) to 1(E), where like numbers designate like parts, reference number 10 generally designates the inventive multi-lobed dimple of the present invention and reference numbers 12, 14, 16, 18 and 20 specifically designate some of the preferred embodiments of the multi-lobed dimple 10 in accordance to the present invention. Preferably, the multi-lobed dimple 10, as shown in FIGS. 1-6, comprises uniform lobes, i.e., uniform size, shape and angular spacing.

In accordance to one aspect of the invention, the dimple 10 comprises a plurality of lobes 22, arranged radially around the center C of the dimple. Each lobe 22 is preferably separated from adjacent lobes by radial lines or spoke-like ridges 24. Preferably, dimple 10 has at least three lobes. FIGS. 1(A)-1(E) illustrate dimple 10 having three lobes to seven lobes, respectively. Dimple 10 may have any number of lobes and the present invention is not limited to any specific embodiment illustrated herein.

Circumferential segments 26 of lobe 22, which are positioned between two adjacent spoke-like ridges 24, are preferably curved. Suitable curved shapes include, but are not limited to, elliptical, parabolic, conic, hyperbolic, sinusoidal, or any combination of these curves, e.g., part of circumferential segment 26 may be elliptical while the other portions may be parabolic or hyperbolic. They may include arbitrary curved shapes that can be defined by spline curves. While a circumferential segment 26 may incorporate localized concavities, it is preferred that each segment be wholly convex. Also, the apex of each lobe may or may not be positioned at the midpoint between adjacent troughs of each lobe.

The surfaces of multi-lobed dimple 10 are preferably curved and preferably comprise a plurality of curved profiles, as shown in cross-sectional views FIGS. 2(A)-2(E). Preferably, each lobe 22 has a curved profile 30 along the radial direction, i.e., a curved profile extending from the apex point of the lobe radially to the center C of the dimple. Each lobe 22 also has a curved profile 32 extending across the width of the lobe, e.g., a curved profile extending from one spoke-like ridge 24 to the adjacent spoke-like ridge 24. These two curved profiles 30, 32 may have the same or different curvatures.

Figure 1B:
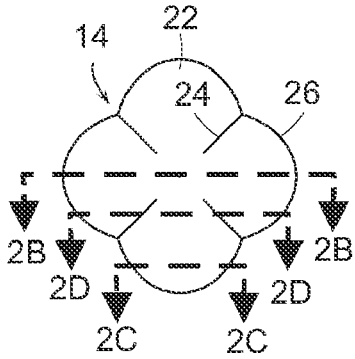
Figure 1C:
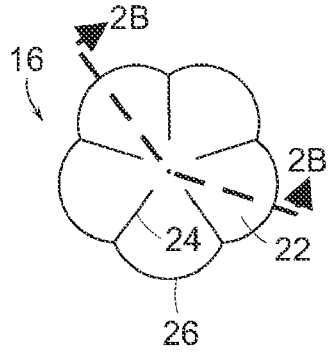
Figure 1D:
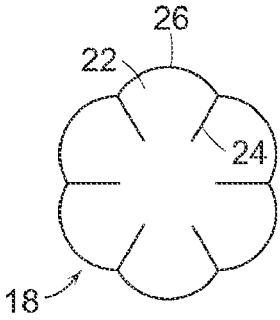
Figure 1E:
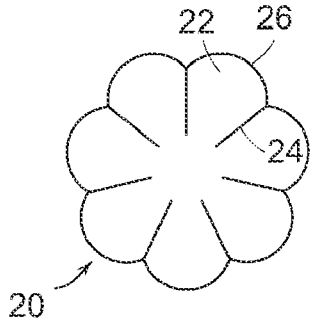
Figure 2A:
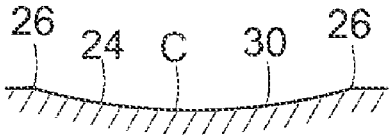
FIGS. 2(A)-2(D) are sectional views along lines 2A-2A, 2B-2B, 2C-2C and 2D-2D, respectively, in FIGS. 1(A)-1(C)
Figure 2B:
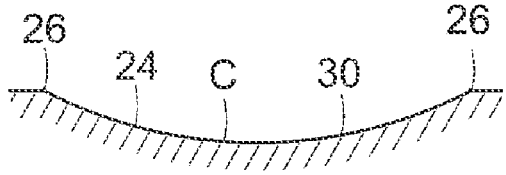
Figure 2C:
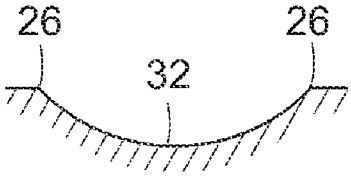
Figure 2D:
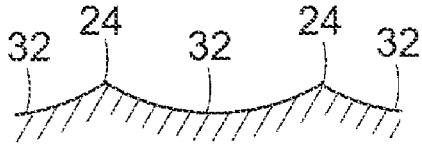
Figure 2E:
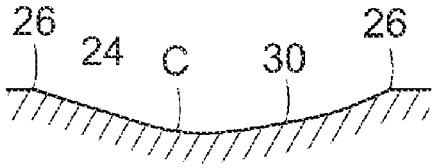
FIG. 2(E) is an alternative embodiment of FIG. 2(A)

FIG. 2(A) is a representative cross-sectional view along line 2A-2A in FIG. 1(A) of a dimple with an odd number of lobes, such as dimples 12, 16 and 20, and FIG. 2(B) is a representative cross-sectional view along line 2B-2B in FIG. 1(B) of a dimple with an even number of lobes, such as dimples 14 and 18. FIG. 2(B) is also a representative sectional view along line 2B-2B of an odd-number lobe dimple, such as FIG. 1(C). FIGS. 2(C) and 2(D) are representative cross-sectional views along lines 2C-2C and 2D-2D in FIG. 1(B), respectively, of a single lobe 22. FIG. 2(E) is an alternative embodiment of FIG. 2(A).

As shown in FIG. 2(A), spoke-like ridge 24 tapers in elevation from the edge of the dimple toward the center C of the dimple. Spoke-like ridge 24 may have a curved profile as shown, or alternatively it may have a linear profile as illustrated in FIG. 2(E). Spoke-like ridge 24 may extend to the center C of the dimple or may extend only partly toward the center. Preferably, the width of each lobe 22 comprises curved profile 32, as shown in FIG. 2(C), wherein curved profile 32 terminates at spoke-like ridge 24 and abuts curved profiles 32 of adjacent lobes, as shown in FIG. 2(D).

An important aspect of multi-lobed dimple 10 is that the center region of the dimple is substantially uninterrupted, as illustrated in FIG. 2(B). In other words, the curved profile 30 extending along the length of lobe 22 is substantially smooth, and the curved profile 30 of one lobe continuously and smoothly extends to and abuts with the curved profile 30 of the opposite lobe or near-opposite lobe, as shown in FIG. 2(B). Some discontinuity at the abutment of curved profiles 30 or at the abutment of curved profile 30 and spoke-like ridge 24 is acceptable, so long as the center region of dimple 10, where these structures abut, remains substantially smooth. The center region may also be substantially smooth and flat, particularly when spoke-like ridges 24 do not extend to the center of the dimple. Hence, the dimple 10 of the present invention has overcome the poor aerodynamic performance of sharp connecting apices and linear edges of the polygonal structures disclosed in the prior art.

Figure 3:
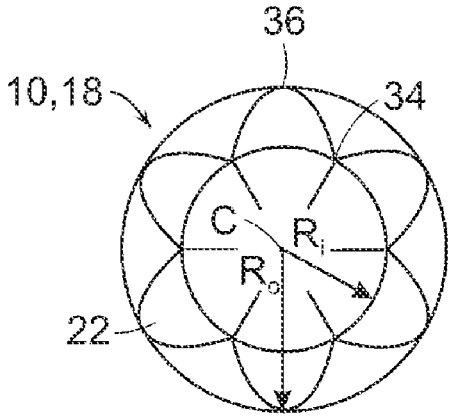
FIG. 3 is a plan view of another embodiment of the dimple of the present invention.

In accordance to another aspect of the present invention, circumferential segment 26 of lobe 22 may have a lesser amount of curvature or prominence as illustrated in FIG. 1(A)-1(E), or a higher amount of curvature or prominence as shown in FIG. 3. The prominence of circumferential segment 26 is defined as the ratio of an inside radius, Ri, to an outside radius, Ro. Ri extends from the center C of the dimple to trough point 34, where two adjacent lobes 22 abut. Ro extends from the center C of dimple to the apex point 36 of lobe 22. When the ratio, Ri/Ro, is close to 1.0, the prominence of circumferential segment 26 is low, such as those shown in FIGS. 1(A)-1(E). When the ratio, Ri/Ro, is significantly less than 1.0, the prominence of circumferential segment 26 is high, such as those shown in FIG. 3. When the ratio, Ri/Ro, equals 1.0, the dimple is substantially circular. Preferred Ri/Ro ratio in accordance to the present invention is between about 0.70 and about 0.95, more preferably between about 0.75 and about 0.90 and most preferably between about 0.80 and about 0.90. For uniform lobes 22 illustrated in FIGS. 1-6, the prominence of the lobes in a single dimple 10 in is also uniform, and the prominence of each lobe is the same as the prominence of the dimple 10. FIGS. 8(A)-8(D) illustrate exemplary dimple 18 with prominence ratios of 0.70, 0.80, 0.90 and 0.95, respectively.

Figure 4:
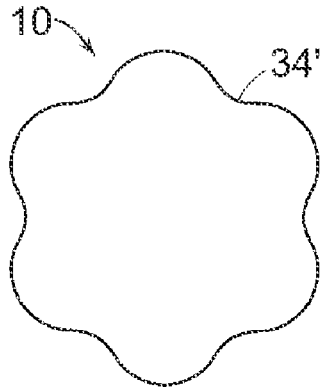
FIG. 4 is a plan view of another embodiment of the dimple of the present invention.

Alternatively, spoke-like ridge 24 may be optionally omitted from dimple 10, as shown in FIG. 4. The perimeter of dimple 10 may also be rounded at points 34', where two adjacent lobes abut, to increase the smoothness of the circumference of the dimple.

Dimples 10 advantageously improve the aerodynamic performance of the golf ball. First, dimples 10 comprise spoke-like ridges 24, which improve the airflow over the dimples, while the perimeter remains substantially round and smooth to take advantage of the superior aerodynamic performance of round dimples. Without being limited to any particular theory, as disclosed in co-pending patent application Ser. No. 09/847,764, filed on May 2, 2001, entitled "Golf Ball Dimples," and assigned to the same assignee as the present invention, structures formed on the dimple surfaces agitate or energize the air flow over the dimple surfaces and thereby reducing the thickness of the boundary layer above dimple surfaces. The disclosure of this co-pending patent application is incorporated herein by reference in its entirety.

Figure 5:
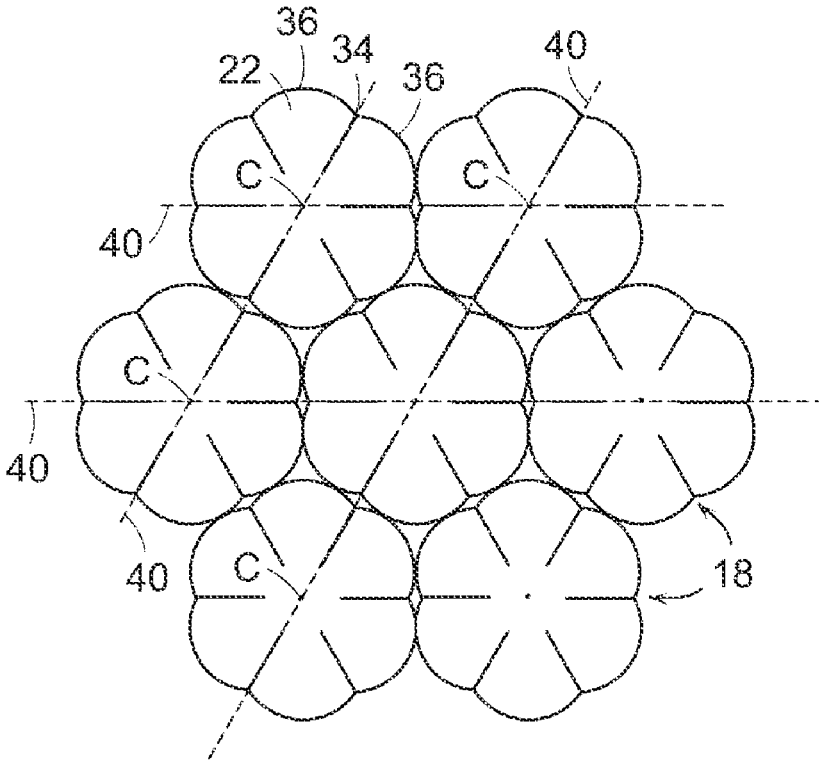
FIG. 5 is a plan view of a hexagonal packing of a preferred embodiment of the present invention.
Figure 6:
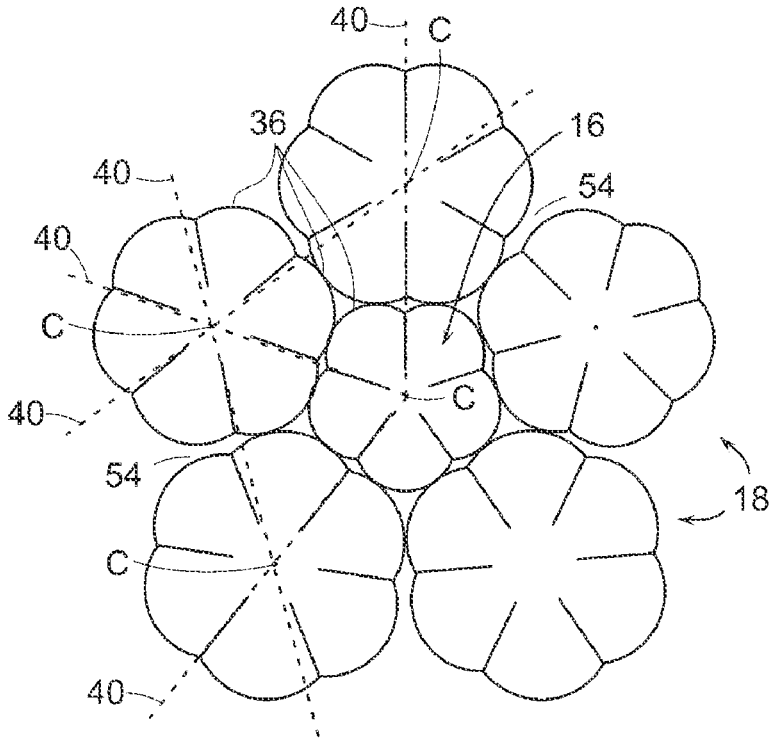
FIG. 6 is a plan view of a packing array for a vertex dimple of a preferred embodiment of the present invention.

Another advantage realized from multi-lobed dimples 10 of the present invention is that due to the shape of the perimeter of dimples 10, the dimple coverage on a golf ball can be increased to more than about 90%, and more preferably to at least about 93%. In order to achieve the highest possible dimple coverage, each multi-lobed dimple is preferably surrounded by six other multi-lobed dimples that are touching or nearly touching it or each other in a hexagonal packing as illustrated in FIG. 5. It has been shown that hexagonal packing provides the highest percentage of dimple coverage. Among the commonly used dimple patterns, those based on the geometry of an icosahedron, i.e., a polyhedron having twenty triangular faces, usually provide the closest approximation to full hexagonal packing. Icosahedron patterns typically have twelve vertex dimples, and in accordance to the present invention each vertex multi-lobed dimple is preferably surrounded by five multi-lobed dimples, as illustrated in FIG. 6. Preferably, the vertex dimples are smaller in size than the surrounding dimples to maximize the dimple coverage.

In accordance to another aspect of the invention, preferably the number of lobes in each multi-lobed dimple 10 matches the number of neighboring dimples. For example, center dimple 18 in FIG. 5 preferably has six lobes 22 and is surrounded by six dimples. Center dimple 16 in FIG. 6 has five lobes 22 and is surrounded by five dimples. In the preferred icosahedron pattern, the twelve vertex dimples are the five-lobed dimples 16 surrounded by five six-lobed dimples 18. The remaining dimples, including the ones surrounding the vertex dimples 16, are the six-lobed dimples 18 and are surrounded by six neighboring dimples.

In accordance to another aspect of the invention, optimal dimple coverage can be realized by a preferred orientation of the dimples. As shown in FIGS. 5 and 6, preferably the apex points 36 of two adjacent lobes 22 straddle an imaginary line 40 (shown in phantom) that connects the centers of any two neighboring dimples. In other words, any two adjacent apex points 36 are separated by a line 40. For example, in the hexagonal packing shown in FIG. 5, any two adjacent apex points 36 are divided by a line 40, and are located equal distances or substantially equal distances from line 40. In the vertex dimple packing shown in FIG. 6, any two apex points 36 are divided by a line 40.

Figure 7:
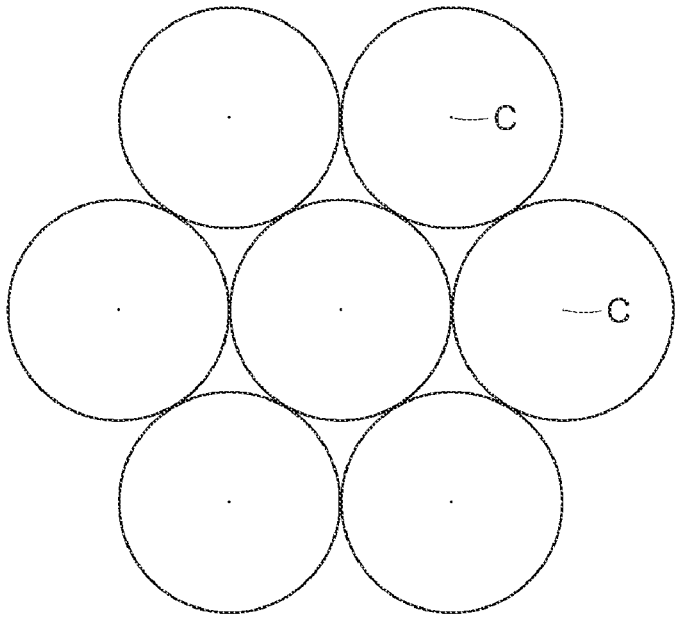
FIG.7 (PRIOR ART)
FIG. 7 is a plan view of a hexagonal packing of conventional circular dimples.
Figure 8A:
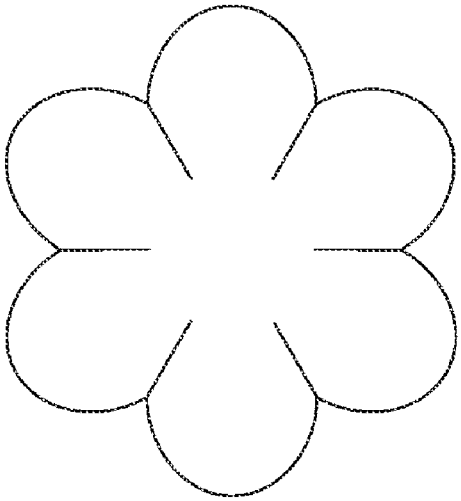
FIGS. 8(A)-8(D) are plan views of an exemplary uniform multi-lobed dimple with various prominence ratios.
Figure 8B:
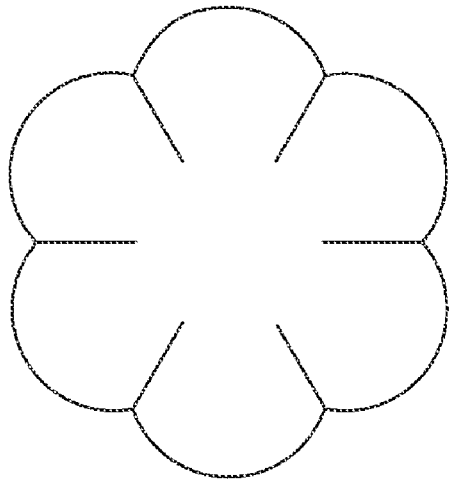
Figure 8C:
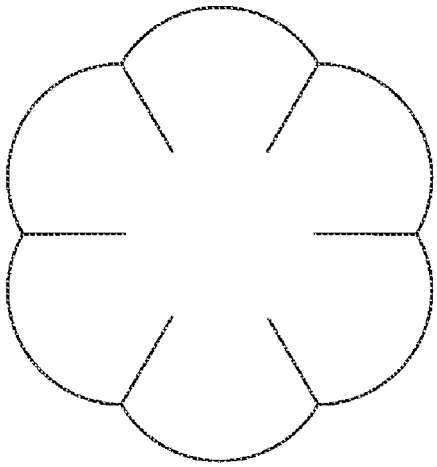
Figure 8D:
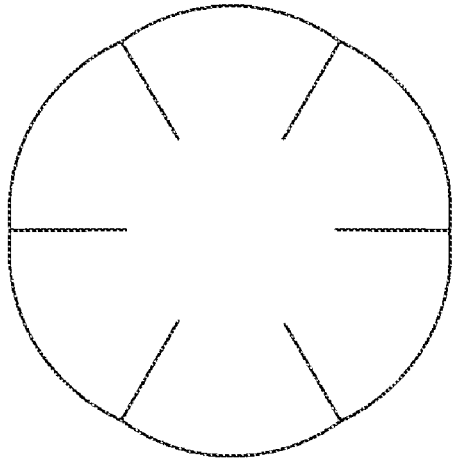

Arrangement of multi-lobed dimples 10 in accordance to the present invention produces significantly higher dimple coverage than arrangement with conventional circular dimples. A region of a golf ball with the six-lobed dimples 18 arranged in a hexagonal array, as shown in FIG. 5, has about 93% dimple coverage. In comparison, the dimple coverage of a dimensionally similar hexagonal array of conventional circular dimples as shown in FIG. 7 is only about 88%. As used herein, "dimensionally similar" means that the centers C of the multi-lobed dimples 18 arranged in hexagonal array shown in FIG. 5 are located at the same corresponding positions as the centers C of the conventional dimples shown in FIG. 7. On commercial golf balls with at least one seam line, the dimple coverage would be a few percentage points less. However, the dimple coverage with the inventive multi-lobed dimples remains significantly higher than the dimple coverage with conventional circular dimples. Hence it can be readily seen that the dimples 10 of the present invention provide much higher dimple coverage to produce golf balls with superior aerodynamic performance.

Another advantage of the dimples 10 is that for dimensionally similar dimple arrangements, such as the hexagonal arrays shown in FIGS. 5 and 7, dimples 10 provide more dimple circumference than non-overlapping conventional circular dimples. This is one of the results of having higher percentage of dimple coverage on the golf ball. As discussed above, since dimple circumference creates turbulence in the boundary layer, the greater dimple circumference length of multi-lobed dimples 10 improves the aerodynamics of golf balls.

In accordance to another aspect of the present invention, the multi-lobed dimples also include non-uniform lobes. As illustrated in FIGS. 9(A)-9(D) and FIG. 10, the size, shape and angular spacing of the lobes of dimple 42 are not uniform. As used herein, reference number 42 generally designates the inventive non-uniform multi-lobed dimple of the present invention, and reference numbers 44, 46, 48, 50 and 52 specifically designate some of the preferred embodiments of the non-uniform multi-lobed dimple in accordance to the present invention. Non-uniform multi-lobed dimples include concentric dimples and eccentric dimples. Concentric non-uniform multi-lobed dimples are dimples wherein the center of the inside radius, Ri, coincides with the center of the outside radius, Ro. Eccentric non-uniform multi-lobed dimples are dimples wherein Ri is spaced apart from Ro.

Figure 9A:
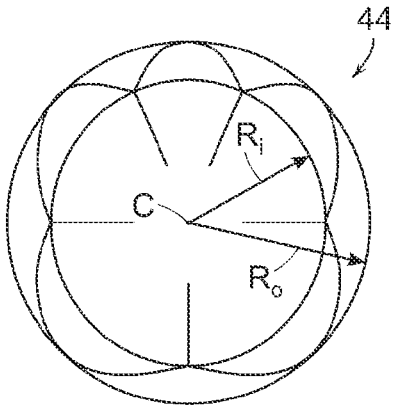
FIGS. 9(A)-9(D) are plan views of preferred embodiments of the non-uniform multi-lobed dimples of the present invention.

An example of concentric non-uniform multi-lobed dimple 44 is illustrated in FIG. 9(A). The lobes of dimple 44 vary in width, i.e., the distance between adjacent troughs 34, and in prominence, i.e., the curvature of the circumferential segments. However, the inside radius, Ri, is the same for all the lobes, and the outside radius is also the same for all the lobes. Concentric non-uniform multi-lobed dimples also include dimples that have constant Ri for all the lobes but varying Ro, dimples that have constant Ro but varying Ri and dimples that have varying Ro and varying Ri.

Figure 9B:
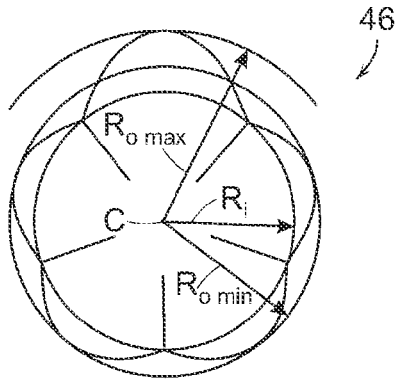
Figure 9C:
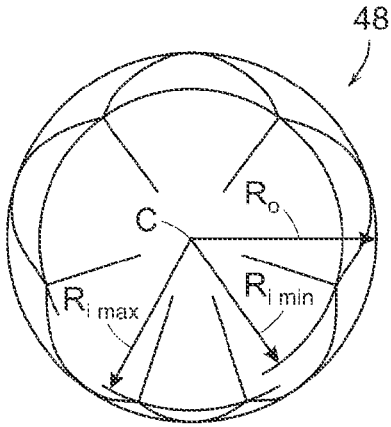
Figure 9D:
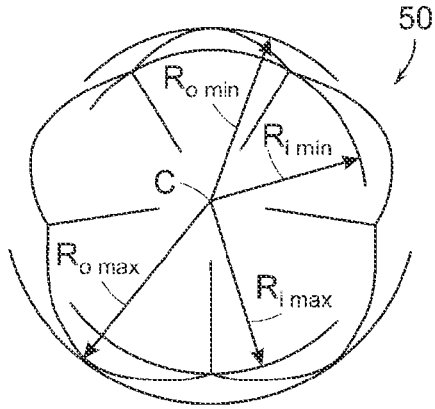

Dimple 46 is an example of a concentric non-uniform multi-lobed dimple with constant Ri and varying Ro. As shown in FIG. 9(B), the inside radius of the lobes is the same, since the troughs 34 are located at a same radial distance from the center, and the apex points of the lobes are located at varying radial distances from this center. Dimple 48, as shown in FIG. 9(C), represents an example of a concentric non-uniform multi-lobed dimple with constant Ro and varying Ri. Dimple 50, as illustrated in FIG. 9(D), is an example of a concentric non-uniform multi-lobed dimple with varying Ro and varying Ri.

The prominence ratio of the concentric non-uniform multi-lobed dimples, including dimples 44, 46, 48 and 50, is the ratio of Ri (or the average Ri, if Ri is varying) to Ro (or the average Ro, if Ro is varying). The average radius, Ro or Ri, is the average of the radii of all the lobes or the average between the maximum radius and the minimum radius.

Figure 10:
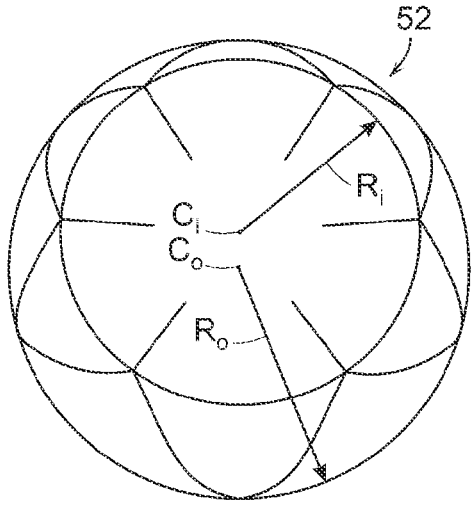
FIG. 10 is a plan view of another preferred embodiment of the non-uniform multi-lobed dimple of the present invention.

Dimple 52, as shown in FIG. 10, illustrates an example of the eccentric non-uniform multi-lobed dimple. As shown, the center Ci of the inside radius Ri is spaced apart from the center Co of the outside radius Ro. Also as shown, Ri and Ro are constant in dimple 52. Similar to the concentric dimples discussed above, either Ri or Ro may vary, or both Ro and Ri may vary. The prominence ratio for the eccentric non-uniform multi-lobed dimples is also defined as the ratio of Ri (or average Ri) to Ro (or average Ro).

An advantage of non-uniform multi-lobed dimples 42 is that these dimples can be used to more efficiently fill spaces that are somewhat irregular in shape. For example, they can be used instead of uniform multi-lobed dimples 10 around the vertex dimples to fill-in gaps 54, as shown in FIG. 6. Lobes from non-uniform dimples 42 may be selectively enlarged to fill-in as much of gaps 54 as possible. The availability of concentric or eccentric multi-lobed dimples with constant or varying Ri and/or Ro provides golf ball designers with the tools to reduce further the land areas in various types of dimple patterns.

The prominence ratios described above have been expressed as ratios of Ri to Ro, or averages thereof. Other ratios may also be used to express the curvature/prominence of the circumferential segments, or the prominence of the dimple. For example, the prominence ratio may alternatively be expressed as a ratio of the difference between Ri and Ro to the width of each lobe, i.e., the linear distance between the troughs, i.e., (Ro-Ri)/(W). The present invention is, therefore, not limited to any particular definition of prominence or curvature.

Alternatively, a golf ball may include inventive dimples 10, as well as conventional dimples. For example, a golf ball with an icosahedron dimple pattern may have dimples 10 arranged along the edges of the icosahedron triangles, and conventional dimples located within the triangles. Furthermore, dimples 10 may have different sizes in order to further improve dimple coverage, similar to the dimple arrangements disclosed in U.S. Pat. Nos. 5,957,786 and 6,358,161B1. The disclosures of the '786 and '161B1 patents are hereby incorporated herein by reference, in their entireties. As disclosed by these references, a golf ball may have circular dimples of many different sizes arranged in an icosahedron pattern to maximize dimple coverage. Multi-lobed dimples 10 in a plurality of sizes may be arranged on a golf ball in a similar pattern.

Alternatively, multi-lobed dimples 10 of the present invention may be arranged in an octahedron or dodecahedron pattern or other patterns. The present invention is not limited to any particular dimple pattern. Additionally, a multi-lobed dimple in accordance to the present invention may comprise at least two lobes and the remaining portion of the dimple is either circular or polygonal.

While various descriptions of the present invention are described above, it is understood that the various features of the embodiments of the present invention shown herein can be used singly or in combination thereof. The multi-lobed dimples of the present invention can be incorporated into other types of objects in flight. Additionally, a plurality of multi-lobed dimples having different Ri/Ro ratios, different number of lobes and different sizes can be incorporated on a single golf ball. This invention is also not to be limited to the specifically preferred embodiments depicted therein.

What is claimed is:

1. A golf ball comprising:

a substantially spherical outer surface; and a plurality of multi-lobed dimples formed on the outer surface of the ball, wherein the lobes in each dimple are positioned radially around the center of the dimple, wherein each lobe is defined by a circumferential segment and wherein said circumferential segment defines a part of the perimeter of the dimple, and wherein a prominence ratio of each multi-lobed dimple is defined by a ratio of an average of an inside radii extending from the center to troughs of the lobes to an average of an outside radii extending from the center to apex points of the lobes, and wherein the ratio is less than 1.0, and wherein the golf ball has a dimple coverage of more than about 90%.

2. The golf ball of claim 1, wherein the dimple coverage is at least about 93%.

3. The golf ball of claim 1, wherein the ratio is between about 0.70 and about 0.95.

4. The golf ball of claim 3, wherein the ratio is between about 0.75 and about 0.90.

5. The golf ball of claim 4, wherein the ratio is between about 0.80 and about 0.90.

6. The golf ball of claim 1, wherein curved profiles of the lobes abut each other in an uninterrupted manner such that the curved profile of one lobe continuously and smoothly extends to and abuts with the curved profile of an opposite or near-opposite lobe across the center of the dimple.

7. The golf ball of claim 1, wherein each lobe is further defined by a spoke-like ridge positioned between adjacent lobes.

8. The golf ball of claim 1, wherein the portions of the perimeter where the circumferential segments abut are rounded.

9. The golf ball of claim 1, wherein the multi-lobed dimples include uniform multi-lobed dimples.

10. The golf ball of claim 1, wherein each lobe further comprises a second curved profile extending across the width of the lobe.

11. The golf ball of claim 1, wherein the number of lobes for each multi-lobed dimple is the same as the number of dimples surrounding said multi-lobed dimple.

12. A golf ball comprising:

a substantially spherical outer surface; and a plurality of multi-lobed dimples formed on the outer surface of the ball, wherein the lobes in each dimple are positioned radially around the center of the dimple, wherein each lobe is defined by a circumferential segment and wherein said circumferential segment defines a part of the perimeter of the dimple, and wherein each lobe comprises a first curved profile extending from the circumferential segment toward the center of the dimple and wherein the first curved profiles of the lobes abut each other in an uninterrupted manner such that the curved profile of one lobe continuously and smoothly extends to and abuts with the curved profile of an opposite or near-opposite lobe, and wherein the golf ball has a dimple coverage of more than about 90%.

13. The golf ball of claim 12, wherein the dimple coverage is at least about 93%.

14. The golf ball of claim 12, wherein each lobe is further defined by a spoke-like ridge positioned between adjacent lobes.

15. The golf ball of claim 12, wherein the portions of the perimeter where the circumferential segments abut are rounded.

16. The golf ball of claim 12, wherein the multi-lobed dimples include uniform multi-lobed dimples.

17. The golf ball of claim 16, wherein a prominence ratio of each uniform multi-lobed dimple is defined by a ratio of an inside radius extending from the center of the dimple to a trough of one of the lobes to an outside radius extending from the center of the dimple to an apex of one of the lobes, and wherein the ratio is less than 1.0.

18. The golf ball of claim 17, wherein the ratio is between about 0.70 and about 0.95.

19. The golf ball of claim 18, wherein the ratio is between about 0.75 and about 0.90.

20. The golf ball of claim 19, wherein the ratio is between about 0.80 and about 0.90.

* * * * *